United States Patent [19]

Streich

[11] 4,310,265

[45] Jan. 12, 1982

[54] PILE WIPER SEAL

[75] Inventor: Steven G. Streich, Duncan, Okla.

[73] Assignee: Halliburton Company, Duncan, Okla.

[21] Appl. No.: 126,060

[22] Filed: Feb. 29, 1980

[51] Int. Cl.[3] ..... E02B 17/00; E02D 5/52

[52] U.S. Cl. ..... 405/227; 405/225

[58] Field of Search ..... 405/195, 224, 225, 227; 138/89; 277/88

[56] References Cited

U.S. PATENT DOCUMENTS

| | | | |
|---|---|---|---|
| 3,533,241 | 10/1970 | Bowerman et al. | 405/227 X |
| 3,570,259 | 3/1971 | Thaxton | 277/5 |
| 4,178,112 | 12/1979 | Knox | 405/227 |
| 4,181,454 | 1/1980 | Knox et al. | 405/227 |
| 4,183,698 | 1/1980 | Coone | 405/227 |
| 4,220,422 | 9/1980 | Sullaway | 405/225 |
| 4,230,424 | 10/1980 | Sullaway | 405/227 |

*Primary Examiner*—David H. Corbin

*Attorney, Agent, or Firm*—John H. Tregoning; James R. Duzan

[57] ABSTRACT

A pile wiper assembly for use on the jacket leg or pile sleeve of a marine platform, the pile wiper member comprising an elastomeric member having reinforcing means throughout and reinforcing member means in the periphery thereof and being retained on the jacket leg or pile sleeve by means of a pair of annular plates.

8 Claims, 4 Drawing Figures

PILE WIPER SEAL

BACKGROUND OF INVENTION

This invention relates to an improved annular wiper seal which is used to prevent the ingress of foreign material from the sea floor into a jacket leg or pile sleeve of a marine platform when driving a piling therethrough.

To secure a marine platform to the sea floor, a pile is usually driven through each of the jacket legs into the sea floor with the top of the pile being secured to the top of the jacket leg, typically, by welding shim plates in the annulus between the jacket leg and pile. If the marine platform also has pile sleeves, piles are usually driven through the pile sleeves into the sea floor. To secure the piles to the pile sleeves and to provide additional support between the piles and the jacket legs of a marine structure, the annuli between the piles and the pile sleeves and jacket legs are usually filled with grouting material.

When a platform is lowered to the sea floor, the jacket legs and pile sleeves will settle into the sea floor with debris from the sea floor being prevented from entering the jacket legs and pile sleeves by means of diaphragms installed on the bottom thereof. Subsequently, upon driving a pile through the jacket leg and pile sleeve when the diaphragm is ruptured, unless prevented, the inrush of debris from the sea floor and mud entrained in water will fill the annulus through the ruptured diaphragm. If the annulus between the pile and jacket leg and pile sleeve is filled with debris and mud, it is desirable to clean the annulus before the grouting thereof to insure filling of the annulus with grouting material and the proper bonding of the grouting material to the pile and jacket leg.

In many instances, an annular wiper seal is installed above the diaphragm to seal the annulus between the pile and jacket leg or pile sleeve to prevent the debris and mud from the sea floor rushing into the annulus when the diaphragm is ruptured by the pile being driven therethrough. When the annulus between the pile and jacket leg and pile sleeve is being filled with grouting material, the annular grout seal may also help support the grout column.

One typical type prior art annular wiper seal as described in U.S. Pat. No. 3,533,241 comprises an elastomeric wiper which is reinforced by means of layers of reinforcing cord therein extending from a point intermediate its inner periphery and outer periphery to its outer periphery, the layers being alternately wrapped about an annular reinforcing member having a circular cross-sectional shape retained within the outer periphery of the wiper. The wiper is secured to the jacket leg or pile sleeve by means of a pair of annular flat plates which protrude from the jacket leg or pile sleeve, each plate having a semicircular groove therein to receive a portion of the outer periphery of the wiper having the circular cross-sectionally shaped reinforcing member therein. The top annular flat plate of the pair of annular flat plates is secured to the jacket leg or pile sleeve by means of welding with the pair of annular flat plates being secured to each other by a plurality of threaded fasteners extending through apertures in the outer periphery of the pair of annular flat plates.

While this typical prior art seal is generally reliable in service, it requires careful wrapping of the layers of reinforcing cord about the annular circular cross-sectionally shaped reinforcing member during the wiper construction process, requires the machining of semicircular shaped grooves in the flat annular plates to receive the outer periphery of the wiper therein, and requires careful torquing of the threaded fasteners to prevent the wiper from being released from the annular flat plates when the pile is inserted and driven therethrough.

Another typical prior art annular wiper seal as described in U.S. Pat. No. 3,570,259 comprises a plurality of wire reinforcing members embedded in elastomeric material. The wiper is held in position in the jacket leg or pile sleeve by means of two annular bands which are welded in position and have an annular channel therein which receives the bent ends of the wire reinforcing members embedded in the elastomeric material. A separate pile guide member is welded in the jacket leg or pile sleeve above the wiper to guide the pile therethrough upon insertion.

While of relatively simple construction, the wiper requires the handling and accurate placement of a large number of wire reinforcing members during the wiper construction process. The wiper additionally requires the use of a separate pile guide member to prevent the pile from damaging the wiper or its securing means when a pile is being inserted therethrough, thereby requiring an extra welding operation to be performed during installation. Furthermore, once the pile has been inserted through the wiper and the reinforcing members plastically deformed, which will occur when the pile is not concentrically located within the wiper or when the pile is withdrawn from the wiper and reinserted therethrough, the wiper is no longer capable of sealingly engaging the periphery of the pile to prevent debris and mud from entering the annulus between the pile and the jacket leg or pile sleeve when the diaphragm is ruptured.

Yet another annular pile wiper as described in U.S. Pat. No. 4,181,454 comprises an elastomeric member having a reinforced peripheral portion which is perpendicular to the sealing portion of the wiper, the wiper being retained within the jacket leg or pile sleeve by upper and lower end shoes engaging the reinforced peripheral portion of the wiper and being welded to the interior of the jacket leg or pile sleeve.

While the wiper is simple to construct, its manufacture may involve costly molding dies.

Still yet another annular wiper seal as described in U.S. Pat. No. 4,183,698 comprises a portion of a combination diaphragm, grouting seal and wiper assembly installed on the lower end of a jacket leg of an offshore platform. The annular wiper seal comprises an elastomeric manifold which acts as a grout seal and pile wiper. The manifold is initially retained within a housing by a shiftable cage having shoulders thereon which protrude into the jacket leg of the platform. As the pile is driven through the jacket leg the pile engages the shoulders on the cage causing the cage to be driven through the diaphragm on the jacket leg with the diaphragm being severed by the cage and the end of the pile. When the cage has been shifted downwardly, the manifold expands into engagement with the pile thereby acting as a pile wiper during pile driving operations and subsequently as a grout manifold during grouting operations. In an alternative embodiment of the combination grout seal and pile wiper, the shiftable cage is eliminated with the reinforced periphery of the diaphragm retaining the manifold in its collapsed state. Upon inserting and driving a pile through the jacket leg, the pile shifts the diaphragm to allow the manifold to expand with the end of the pile severing the diaphragm.

While the combination of a grout seal and pile wiper may offer advantages over a separate pile wiper assembly and grout seal assembly installed on the jacket leg of an offshore platform, the combination grout seal and pile wiper may be damaged during pile insertion and driving operations and fail to perform either as a pile wiper or grout seal.

SUMMARY OF INVENTION

In contrast to the prior art annular wiper seals the present invention comprises an elastomeric member having reinforcement means throughout the entire periphery and having positive anchoring means engaging the outer periphery of the annular wiper seal to retain the seal in the lower end of a jacket leg or pile sleeve of a marine structure.

The foregoing invention will be appreciated and understood from the following specification and drawings wherein:

DESCRIPTION OF PREFERRED EMBODIMENTS

Figure 1:
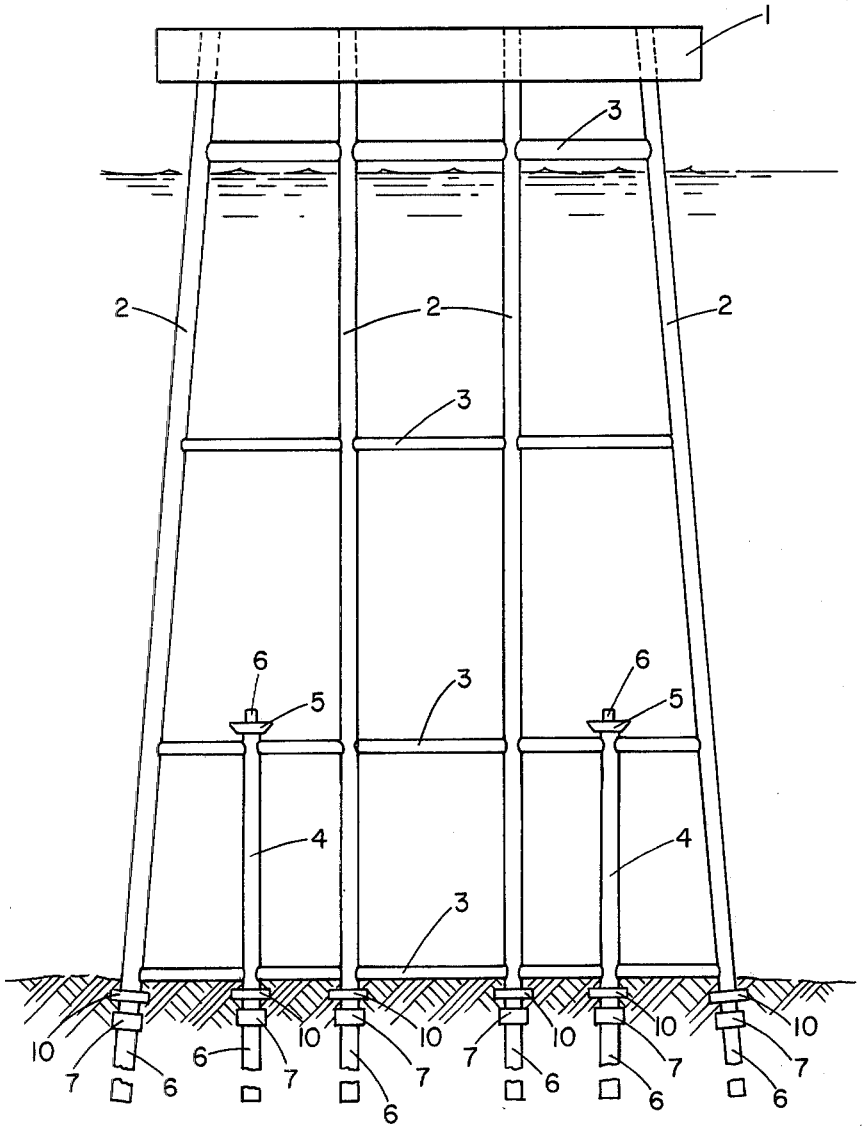
FIG. 1 is a side elevational view of a marine platform having jacket legs and pile sleeves between the jacket legs, the marine platform resting on the bottom of a body of water.

Referring to FIG. 1, a marine platform 1 having tubular supporting legs 2 between which horizontal reinforcing members 3 are connected is shown. Tubular piling guides or pile sleeves 4, which may have flared upper ends 5, are supported between the lower end portion of the legs 2 by the lower reinforcing members 3 and, as the legs, are adapted to rest upon or have their lower extremities slightly embedded in the bottom of a body of water.

The marine platform 1 is anchored or secured in position by driving piles 6 through the legs 2 or guides 4 into the bottom of the body of water. Upon completion of the pile driving, the piles 6 are welded to the tops of the legs 2 and the annulus between each leg 2 and guide 4 and its associated pile 6 is filled with grout to provide a unitary base structure by securing the guide 4 to its associated pile 6 and by providing a uniform load bearing structure with respect to the leg 2 and its associated pile 6.

Contained on the bottom of each leg 2 and guide sleeve 4 is a wiper assembly 10 and rupturable diaphragm seal assembly 7.

Figure 2:
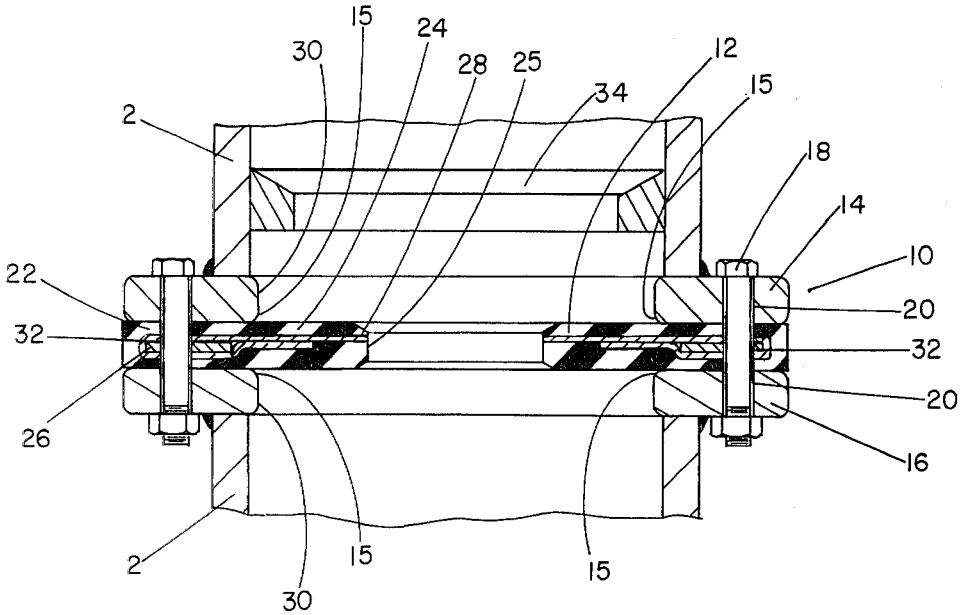
FIG. 2 is a cross-sectional view of a first embodiment of the present invention.

Referring to FIG. 2, a first embodiment of the present invention is shown. The wiper assembly 10 comprises an elastomeric wiper member 12 retained between an upper annular plate 14 and lower annular plate 16, the annular plates 14 and 16 having inner radiused edges 15 thereon. The upper annular plate 14 is secured to the lower annular plate 16 by means of a plurality of threaded fastening members 18 extending through apertures 20 in the plates 14 and 16. As shown, the wiper assembly 10 is installed in a jacket leg 2 of a marine platform being secured thereto by any suitable means, such as welding.

The elastomeric wiper member 12 comprises an elastomeric member having a peripheral portion 22 which is contained between the upper 14 and lower 16 annular plates, having a sealing portion 24 which contains a central aperture 25 therein, having an annular reinforcing member 26 located in the peripheral portion 22 which, in turn, has a generally rectangular cross-sectional shape, and having annular reinforcing means 28 which extends from the central aperture 25 in the sealing portion 24, through the peripheral portion 22, being wrapped and secured to the annular reinforcing member 26 in the peripheral portion 22 and terminating inwardly of the aperture 30 in either the upper 14 and lower 16 annular plates. The elastomeric wiper member 12 also contains a plurality of apertures 32 in the peripheral portion 22 which extend through the annular reinforcing means 28 and annular reinforcing member 26 and which receive the threaded fastening means 18 therein when the wiper member 12 is installed between the upper 14 and lower 16 annular plates secured to the jacket leg 2 of a marine platform.

The annular reinforcing member 26 may be fabricated from any suitable metal, such as steel. The annular reinforcing member 26 provides sufficient reinforcement in the peripheral portion of the annular wiper member 12 to prevent the wiper member 12 from readily tearing or being pulled from between the upper 14 and lower 16 annular plates upon the insertion and driving of a pile therethrough. Any desired thickness or number of annular reinforcing members 26 may be utilized in the peripheral portion 22 of the annular wiper member 12, depending upon the expected piling loads to be exerted upon the wiper member 12.

The annular reinforcing means 28 may be of any suitable fabric, although nylon is preferred. Also, the annular reinforcing means 28 may be secured to the annular reinforcing member 26 by any suitable means, although adhesively bonding the annular reinforcing means 28 to the annular reinforcing member 26, utilizing a thin layer of elastomeric material between the means 28 and member 26, is preferred. Also, by wrapping and securing the annular reinforcing means 28 to the annular reinforcing member 26 and extending the annular reinforcing means 28 back into the sealing portion 24 of the wiper member 12 when the wiper member 12 is deflected by the force of a piling being inserted and driven therethrough, the outer portion of the sealing portion 24 contacts the inner radiused edges 15 of the annular flat plates 14 and 16 secured to the jacket leg or pile sleeve, the additional reinforcement of the annular reinforcing means 28 in the area of the inner radiused edges 15 of the annular flat plates 14 and 16 helping to prevent severing and tearing of the annular reinforcing means 28 in the area of the inner radiused edges 15.

It should be noted that the annular reinforcing means 28 will comprise one or more unitary layers of woven fabric which have a first portion extending throughout the sealing portion and the peripheral portion of the wiper member and have a second portion wrapped and secured to the annular reinforcing member 26 and to each other depending upon the desired strength of elastomeric wiper member 12, the second portion terminating in the sealing portion of the wiper member inwardly of the the inner diameter 30 of the annular plates 14 and 16. The more layers of fabric in the annular reinforcing means 28, the stiffer and more resistant to deflection the elastomeric wiper member 12 will be, thereby allowing the elastomeric wiper member 12 to withstand a greater fluid pressure differential thereacross without incurring fluid leakage around a piling inserted therethrough. By wrapping and securing the layers of woven fabric of the annular reinforcing means 28 to the annular reinforcing member 26, the elastomeric wiper member 12 will exhibit increased strength and resist the tearing or severing thereof from the annular reinforcing member 26 when a pile is inserted therethrough when the annular reinforcing means 28 are placed in tension by a longitudinal force.

The sealing portion 24 of the elastomeric wiper member 12 may extend any desired distance into the jacket leg 2 or pile sleeve 4, depending upon the relative sizes of the jacket leg 2 or pile sleeve 4 and its associated pile 6. Only a limited amount of engagement between the sealing portion 24 of the wiper member 12 and the pile inserted therethrough is desired to prevent undue tearing of the warps and wefts of the woven fabric by the pile and since the wiper member 12 must be capable of sealing the annulus between the jacket leg or pile sleeve and the piling during both upward and downward movement of the piling therethrough. Unless the piling is physically lifted upward after the insertion thereof through the wiper member 12, upward movement of the piling through the wiper member 12 generally occurs when driving the pile into the sea floor. After each hammer blow on the pile, due to the natural resiliency of the pile and the geological formations into which the pile is being driven, the pile springs or bounces upwardly requiring the sealing portion 24 of the wiper member 12 to flex upwardly while maintaining sealing engagement with the pile being driven therethrough.

The annular wiper member 12 may be formed of any suitable elastomeric material, such as rubber, synthetic rubber, etc.

To assist in guiding the piling through the wiper assembly 10 to help prevent damage to the annular wiper member 12, a pile guide ring 34 may be installed in the jacket leg or pile sleeve at any convenient location therein.

Figure 3:
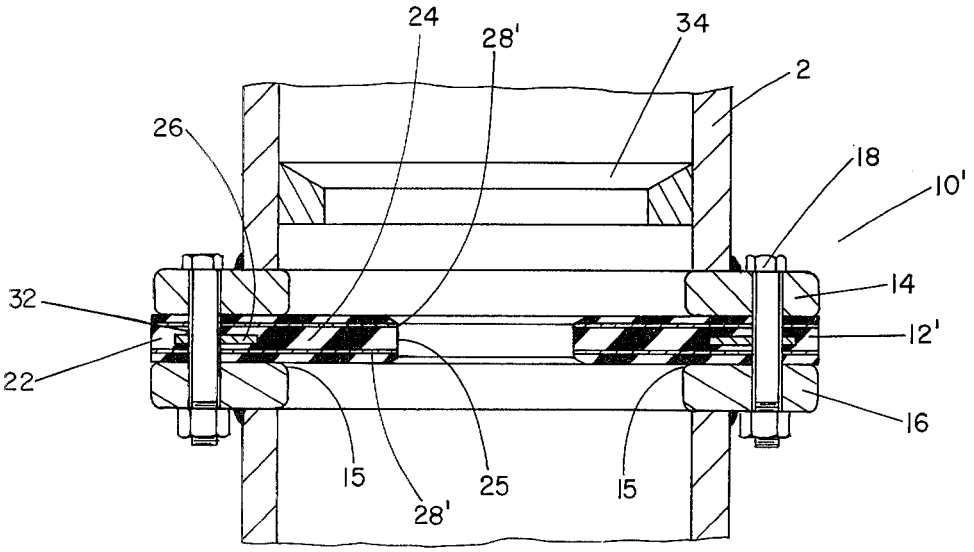
FIG. 3 is a cross-sectional view of a second embodiment of the present invention.

Referring to FIG. 3, a second embodiment of the present invention is shown. The wiper assembly 10' comprises an elastomeric wiper member 12' retained between an upper annular plate 14 and lower annular plate 16. The wiper assembly 10' is identical to the wiper assembly 10 described hereinbefore except for the construction of the elastomeric wiper member 12'.

The elastomeric wiper member 12' comprises an elastomeric member having a peripheral portion 22 which is contained between the upper 14 and lower 16 annular plates, having a sealing portion 24 which contains central aperture 25 therein, having an annular reinforcing member 26 which, in turn, has a generally rectangular cross-sectional shape located in the peripheral portion 22, and having annular reinforcing means 28' which extend from the central aperture 25 in the sealing portion 24 through the peripheral portion 22. The elastomeric wiper member 12' also contains a plurality of apertures 32 in the peripheral portion 22 which extend through the annular reinforcing means 28 and annular reinforcing member 26 and which receive the threaded fastening means 18 therein when the wiper member 12' is installed between the upper 14 and lower 16 annular plates secured to the jacket leg 2 of a marine platform.

The annular reinforcing means 28' may be of any suitable fabric, although nylon is preferred. The annular reinforcing means 28' comprise a plurality of unitary layers of woven fabric, at least one layer of fabric being positioned on either side of the annular reinforcing member 26, which are positioned in the annular wiper member 12' such that a layer of elastomeric material is present between the annular reinforcing member 26 and the annular reinforcing means 28. By placing the layers of fabric comprising the annular reinforcing means 28' nearer to the surfaces of the annular wiper member 12', the wiper member 12' is less likely to become caught upon irregularities on the end of a pile when it is being inserted therethrough or on irregularities on the surface of a pile when it is being driven.

Figure 4:
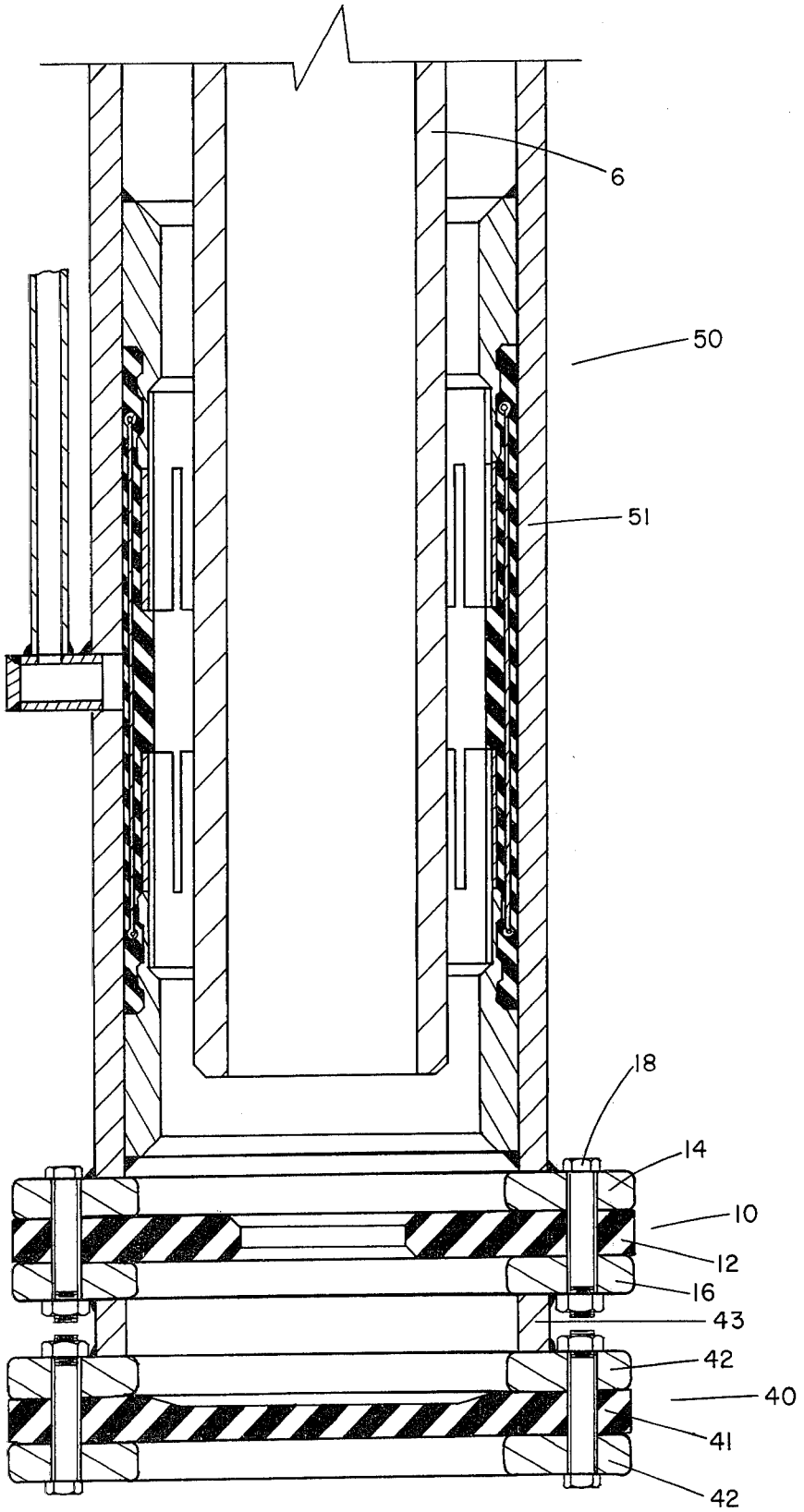
FIG. 4 is a cross-sectional view of the present invention installed in a jacket leg or pile sleeve of a marine structure in conjunction with an inflatable packer and diaphragm.

Referring to FIG. 4, the wiper assembly 10 is shown in conjunction with an inflatable packer assembly 50 and diaphragm assembly 40. The wiper assembly 10 is shown installed on the end of an extended case 51, which is, in turn, secured to the lower end of a jacket leg 2 or pile sleeve 4 (not shown). The diaphragm assembly 40 comprises a pair of flanges 42, the upper flange being secured to a transition piece 43 which extends from the lower annular plate 16 of the wiper assembly 10, and diaphragm member 41 being retained in sealing engagement between the flanges 42 by means of a plurality of threaded fastening means 43.

As shown, when the pile 6 is inserted through the annular wiper member 12, the wiper member 12 will seal the annulus between the pile 6 and the extended case 51 of the inflatable packer 30, thereby preventing the entry of debris and mud entrained in water after the diaphragm member 41 has been ruptured by driving the pile 6 therethrough.

It should be noted that although the sealing portions 24 of the wiper members 12 and 12' have been shown in FIGS. 2 through 4 of the drawings as extending perpendicularly or at substantially a right angle from the jacket leg or pile sleeve of a marine platform, the sealing portions 24 may be formed at an acute angle with respect to the jacket leg or pile sleeve, thereby forming a conically shaped sealing portion to assist in inserting a pile therethrough.

From the foregoing, it can be easily seen that the present invention offers the advantages of:

Simplicity of annular wiper member construction;

Positive retention of the annular wiper member by the annular flat plates secured to either the jacket legs or pile sleeves of a marine platform;

Simplicity of annular plate construction requiring little machining thereof;

Simplicity of attachement to a jacket leg or pile sleeve of a marine platform; and Adaptability for use with an inflatable packer and/or diaphragm installed on the jacket leg or pile sleeve of a marine platform.

Having thus described my invention, I claim:

1. A pile wiper seal assembly sealing the annulus between either a tubular jacket leg or tubular pile sleeve and a pile inserted therethrough of a marine platform, said pile wiper seal assembly comprising:

annular wiper member means having a peripheral portion and a sealing portion extending inwardly therefrom having a centrally located aperture therein, said annular wiper member means comprising:

elastomeric member means;

annular reinforcing member means having a generally rectangular cross-sectional shape located in the peripheral portion of said annular wiper member means; and annular reinforcing means extending throughout the peripheral portion and the sealing portion of said annular wiper member means terminating at the centrally located aperture therein and being secured to the annular reinforcing member means in the peripheral portion of said annular wiper member means; and annular wiper member retaining means comprising:

a pair of annular plate means, each annular plate means of the pair being secured to the other by a plurality of fastening means extending through the elastomeric member means, the annular reinforcing member means and the annular reinforcing means of the peripheral portion of said annular wiper member means, said annular wiper member retaining means having at least one of the pair of annular plate means secured to either said tubular jacket leg or said tubular pile sleeve of said marine platform.

2. The pile wiper seal assembly of claim 1 wherein the annular reinforcing means comprise a plurality of annular reinforcing means located on either side of the annular reinforcing member means.

3. The pile wiper seal assembly of claim 2 wherein at least one annular reinforcing means of the plurality of annular reinforcing means is located on each side of the annular reinforcing member means within the elastomeric member means adjacent the surface thereof.

4. The pile wiper seal assembly of claim 1 wherein the annular reinforcing means comprise annular reinforcing means having a first portion extending throughout the sealing portion and the peripheral portion of said annular wiper member means and having a second portion wrapped and secured to the annular reinforcing member means and extending inwardly therefrom into the sealing portion of said annular wiper member means terminating inwardly of the inner diameter of said annular wiper member retaining means.

5. The pile wiper seal assembly of claim 4 wherein the annular reinforcing means comprise a plurality of layers of fabric.

6. The pile wiper seal assembly of claim 3 wherein the annular reinforcing means comprise a plurality of layers of fabric.

7. A pile wiper seal assembly sealing the annulus between either a tubular jacket leg or tubular pile sleeve and a pile inserted therethrough of a marine platform, said pile wiper seal assembly comprising:

annular wiper member means having a peripheral portion and a sealing portion extending inwardly therefrom having a centrally located aperture therein, said annular wiper member means comprising:

elastomeric member means;

annular reinforcing member means having a generally rectangular cross-sectional shape located in the peripheral portion of said annular wiper member means; and annular reinforcing means extending throughout the peripheral portion and the sealing portion of said annular wiper member means terminating at the centrally located aperture therein and being secured to the annular reinforcing member means in the peripheral portion of said annular wiper member means, the annular reinforcing means comprising:

a plurality of annular reinforcing means wherein at least one annular reinforcing means of the plurality is located on each side of the annular reinforcing member means within the elastomeric member means adjacent the surface thereof; and annular wiper member retaining means comprising:

a pair of annular plate means, each annular plate means of the pair being secured to the other by a plurality of fastening means extending through the elastomeric member means, the annular reinforcing member means and the annular reinforcing means of the peripheral portion of said annular wiper member means, said annular wiper member retaining means having at least one of the pair of annular plate means secured to either said tubular jacket leg or said tubular pile sleeve of said marine platform.

8. A pile wiper seal assembly sealing the annulus between either a tubular jacket leg or tubular pile sleeve and a pile inserted therethrough of a marine platform, said pile wiper seal assembly comprising:

annular wiper member means having a peripheral portion and a sealing portion extending inwardly therefrom having a centrally located aperture therein, said annular wiper member means comprising:

elastomeric member means;

annular reinforcing member means having a generally rectangular cross-sectional shape located in the peripheral portion of said annular wiper member means; and annular reinforcing means extending throughout the peripheral portion and the sealing portion of said annular wiper member means terminating at the centrally located aperture therein and being secured to the annular reinforcing member means in the peripheral portion of said annular wiper member means, the annular reinforcing means comprising:

annular reinforcing means having a first portion extending throughout the sealing portion and the peripheral portion of said annular wiper member means and having a second portion wrapped and secured to the annular reinforcing member means and extending inwardly therefrom into the sealing portion of said annular wiper member terminating inwardly of the inner diameter of said annular wiper retaining means; and annular wiper member retaining means comprising:

a pair of annular plate means, each annular plate means of the pair being secured to the other by a plurality of fastening means extending through the elastomeric member means, the annular reinforcing member means and the annular reinforcing means of the peripheral portion of said annular wiper member means, said annular wiper member retaining means having at least one of the pair of annular plate means secured to either said tubular jacket leg or said tubular pile sleeve of said marine platform.

* * * * *